US012691494B2

(12) United States Patent
Cheng et al.

(10) Patent No.: US 12,691,494 B2
(45) Date of Patent: Jul. 28, 2026

(54) METHOD FOR PRODUCING TANTALUM POWDER AND TANTALUM POWDER OBTAINED BY THE METHOD

(71) Applicant: NINGXIA ORIENT TANTALUM INDUSTRY CO., LTD., Shizuishan (CN)

(72) Inventors: Yuewei Cheng, Shizuishan (CN); Hongyuan Liang, Shizuishan (CN); Shun Guo, Shizuishan (CN); Jinfeng Zheng, Shizuishan (CN); Haiyan Ma, Shizuishan (CN); Jingyi Zuo, Shizuishan (CN); Li Zhang, Shizuishan (CN); Hongjie Qin, Shizuishan (CN); Tong Liu, Shizuishan (CN); Ying Wang, Shizuishan (CN)

(73) Assignee: NINGXIA ORIENT TANTALUM INDUSTRY CO., LTD., Shizuishan (CN)

( * ) Notice: Subject to any disclaimer, the term of this patent is extended or adjusted under 35 U.S.C. 154(b) by 373 days.

(21) Appl. No.: 18/284,362

(22) PCT Filed: Aug. 24, 2022

(86) PCT No.: PCT/CN2022/114375
§ 371 (c)(1),
(2) Date: Sep. 27, 2023

(87) PCT Pub. No.: WO2023/109172
PCT Pub. Date: Jun. 22, 2023

(65) Prior Publication Data

US 2024/0157437 A1 May 16, 2024

(30) Foreign Application Priority Data

Dec. 15, 2021 (CN) ..... 202111533324.8

(51) Int. Cl.
*B22F 1/142* (2022.01)
*B22F 1/00* (2022.01)
(Continued)

(52) U.S. Cl.
CPC ..... *B22F 1/142* (2022.01); *B22F 1/00* (2013.01); *B22F 1/145* (2022.01); *C22B 34/24* (2013.01);
(Continued)

(58) Field of Classification Search
CPC .. B22F 1/142; B22F 1/00; B22F 1/145; B22F 2301/20; B22F 2999/00; C22B 34/24
See application file for complete search history.

(56) References Cited

U.S. PATENT DOCUMENTS 3,415,639 A 12/1968 Gustav et al.
3,647,415 A * 3/1972 Yano ..... B22F 1/068 75/255
(Continued)

FOREIGN PATENT DOCUMENTS

AU 4978590 A 8/1990
BE 1002754 A3 5/1991
(Continued)

OTHER PUBLICATIONS

English language abstract and machine-assisted English translation for JP 2005-001920 A extracted from espacenet. com database on Nov. 1, 2024, 35 pages.
(Continued)

*Primary Examiner* — Tima M. Mcguthry-Banks
(74) *Attorney, Agent, or Firm* — Howard & Howard Attorneys PLLC

(57) ABSTRACT

A method produces tantalum powder. The method includes: (1) uniformly mixing a tantalum powder raw material, metal magnesium and at least one alkali metal and/or alkaline
(Continued)

earth metal halide, loading the mixture into a container, and putting the container in a furnace; (2) raising the temperature of the furnace to 600-1200° C. in the presence of inert gas, and soaking; (3) at the end of soaking, lowering the temperature of the furnace to 600-800° C., vacuumizing the interior of the furnace to 10 Pa or less, soaking under the negative pressure so that the excessive metal is separated; (4) thereafter, raising the temperature of the furnace to 750-1200° C. in the presence of inert gas, and soaking so that the tantalum powder is sintered in the molten salt after oxygen reduction; (5) then cooling to room temperature and passivating to obtain a mixed material containing halide and tantalum powder; and (6) separating the tantalum powder from the resulting mixture.

14 Claims, 1 Drawing Sheet

(51) Int. Cl.
*B22F 1/145* (2022.01)
*C22B 34/24* (2006.01)

(52) U.S. Cl.
CPC ..... *B22F 2301/20* (2013.01); *B22F 2999/00* (2013.01)

(56) References Cited

U.S. PATENT DOCUMENTS

| | | | | |
|---|---|---|---|---|
| 4,490,340 | A | 12/1984 | Ritsko et al. | |
| 5,068,097 | A | 11/1991 | Eckert et al. | |
| 5,242,481 | A | 9/1993 | Kumar | |
| 5,635,146 | A | 6/1997 | Singh et al. | |
| 6,786,951 | B2 | 9/2004 | He et al. | |
| 7,399,335 | B2 | 7/2008 | Shekhter et al. | |
| 8,562,765 | B2 | 10/2013 | Yuan | |
| 11,508,529 | B2 * | 11/2022 | Sungail | H01G 11/00 |
| 2003/0070509 | A1 | 4/2003 | Osako et al. | |
| 2003/0110890 | A1 * | 6/2003 | He | B22F 9/24 75/363 |
| 2006/0213327 | A1 | 9/2006 | Shekhter et al. | |
| 2007/0178040 | A1 | 8/2007 | Kikuyama et al. | |
| 2017/0072462 | A1 | 3/2017 | Li et al. | |
| 2020/0206709 | A1 | 7/2020 | Leclaire et al. | |
| 2024/0198422 | A1 * | 6/2024 | Cheng | B22F 9/20 |

FOREIGN PATENT DOCUMENTS

| | | | |
|---|---|---|---|
| BR | 9000642 | A | 1/1991 |
| CN | 1052070 | A | 6/1991 |
| CN | 1023548 | C | 1/1994 |
| CN | 1251325 | A | 4/2000 |
| CN | 1308566 | A | 8/2001 |
| CN | 1340631 | A | 3/2002 |
| CN | 1382548 | A | 12/2002 |
| CN | 1410209 | A | 4/2003 |
| CN | 1278804 | C | 10/2006 |
| CN | 101146918 | A | 3/2008 |
| CN | 101574741 | A | 11/2009 |
| CN | 102120258 | A | 7/2011 |
| CN | 101189089 | B | 9/2011 |
| CN | 202072753 | U | 12/2011 |
| CN | 202072754 | U | 12/2011 |
| CN | 202072755 | U | 12/2011 |
| CN | 102120258 | B | 12/2012 |
| CN | 103274468 | A | 9/2013 |
| CN | 102994780 | B | 5/2014 |
| CN | 104310323 | A | 1/2015 |
| CN | 102990076 | B | 2/2015 |
| CN | 104386751 | A | 3/2015 |
| CN | 204430275 | U | 7/2015 |
| CN | 104918734 | A | 9/2015 |
| CN | 104936729 | A | 9/2015 |
| CN | 105033283 | A | 11/2015 |
| CN | 105665731 | A | 6/2016 |
| CN | 105883919 | A | 8/2016 |
| CN | 105051223 | B | 7/2018 |
| CN | 110156082 | A | 8/2019 |
| CN | 111850686 | A | 10/2020 |
| CN | 112011804 | A | 12/2020 |
| CN | 112267017 | A | 1/2021 |
| CN | 112592180 | A | 4/2021 |
| CN | 114057227 | A | 2/2022 |
| CN | 114192791 | A | 3/2022 |
| CN | 114210973 | A | 3/2022 |
| CN | 114210973 | B | 3/2023 |
| DE | 3904292 | A1 | 8/1990 |
| DE | 291978 | A5 | 7/1991 |
| EP | 0665302 | B1 | 5/2000 |
| EP | 3486338 | A1 | 5/2019 |
| GB | 1094283 | A | 12/1967 |
| GB | 2233349 | B | 3/1994 |
| GB | 0619842 D0 | | 10/2006 |
| JP | H02248325 | A | 10/1990 |
| JP | H0336229 | A | 2/1991 |
| JP | 2003013115 | A | 1/2003 |
| JP | 2005001920 | A | 1/2005 |
| JP | 2006263504 | A | 10/2006 |
| JP | 2007277091 | A | 10/2007 |
| JP | 2009167065 | A | 7/2009 |
| JP | 2019163542 | A | 9/2019 |
| WO | 0067936 | A1 | 11/2000 |
| WO | 2008041007 | A1 | 4/2008 |

OTHER PUBLICATIONS

English language abstract and machine-assisted English translation for JP 2007-277091 A extracted from espacenet. com database on Nov. 1, 2024, 15 pages.

English language abstract and machine-assisted English translation for JP 2009-167065 A extracted from espacenet. com database on Nov. 1, 2024, 15 pages.

Kryzhanov, M.V et al., "Thermodynamic Modeling of Magnesiothermic Reduction of Niobium and Tantalum from Pentoxides", Russian Journal of Applied Chemistry, vol. 83, No. 3, 2010, pp. 379-383.

Singh, Raj P., "Processing of Ta2O5 Powders for Electronic Applications", Journal of Electronic Materials, vol. 30, No. 12, 2001, pp. 1584-1594.

Won, H.I. et al., "Combustion Synthesis-Derived Tantalum Powder for Solid-Electrolyte Capacitors", Journal of Alloys and Compounds, vol. 78, 2009, pp. 716-720.

International Search Report for Application No. PCT/CN2022/114375 dated Oct. 10, 2022, 2 pages.

English language abstract for CN 1410209 A extracted from espacenet. com database on Sep. 27, 2023, 2 pages.

English language abstract and machine-assisted English translation for CN 102120258 A extracted from espacenet. com database on Sep. 27, 2023, 18 pages.

English language abstract for CN 101189089 B extracted from espacenet.com database on Sep. 27, 2023, 2 pages.

English language abstract and machine-assisted English translation for CN 202072753 U extracted from espacenet. com database on Sep. 27, 2023, 11 pages.

English language abstract and machine-assisted English translation for CN 202072754 U extracted from espacenet. com database on Sep. 27, 2023, 10 pages.

English language abstract and machine-assisted English translation for CN 202072755 U extracted from espacenet. com database on Sep. 27, 2023, 12 pages.

English language abstract and machine-assisted English translation for CN 102120258 B extracted from espacenet. com database on Sep. 27, 2023, 18 pages.

English language abstract and machine-assisted English translation for CN 102994780 B extracted from espacenet. com database on Sep. 27, 2023, 16 pages.

(56) References Cited

OTHER PUBLICATIONS

English language abstract and machine-assisted English translation for CN 102990076 B extracted from espacenet. com database on Sep. 27, 2023, 13 pages.
English language abstract and machine-assisted English translation for CN 204430275 U extracted from espacenet. com database on Sep. 27, 2023, 8 pages.
English language abstract and machine-assisted English translation for CN 105665731 A extracted from espacenet. com database on Sep. 27, 2023, 12 pages.
English language abstract and machine-assisted English translation for CN 105051223 B extracted from espacenet. com database on Sep. 27, 2023, 20 pages.
English language abstract and machine-assisted English translation for CN 114210973 A extracted from espacenet. com database on Sep. 27, 2023, 15 pages.
English language abstract for JPH 03-36229 A extracted from espacenet. com database on Aug. 6, 2024, 2 pages.
Abstract and partial English language translation for and original Chinese language document of LU, Jianbo, "Tantalum and Niobium Patent Research". vol. 24, No. 5, Dec. 28, 2005, 18 pages.
English language abstract and machine-assisted English translation for CN 1278804 C extracted from espacenet.com database on Sep. 28, 2023, 13 pages.
English language abstract and machine-assisted English translation for CN 1382548 A extracted from espacenet.com database on Sep. 28, 2023, 12 pages.
English language abstract and machine-assisted English translation for CN 102120258 B extracted from espacenet.com database on Sep. 28, 2023, 18 pages.
English language abstract and machine-assisted English translation for CN 1023548 C extracted from espacenet.com database on Sep. 28, 2023, 4 pages.
English language abstract and machine-assisted English translation for CN 102990076 B extracted from espacenet.com database on Sep. 28, 2023, 13 pages.
English language abstract and machine-assisted English translation for CN 102994780 B extracted from espacenet.com database on Sep. 28, 2023, 16 pages.
English language abstract and machine-assisted English translation for CN 103274468 A extracted from espacenet.com database on Sep. 27, 2023, 8 pages.
English language abstract and machine-assisted English translation for CN 104310323 A extracted from espacenet.com database on Sep. 27, 2023, 16 pages.
English language abstract and machine-assisted English translation for CN 104386751 A extracted from espacenet.com database on Sep. 27, 2023, 20 pages.
English language abstract and machine-assisted English translation for CN 104936729 A extracted from espacenet.com database on Sep. 28, 2023, 13 pages.
English language abstract and machine-assisted English translation for CN 105051223 B extracted from espacenet.com database on Sep. 28, 2023, 21 pages.
English language abstract and machine-assisted English translation for CN 1052070 A extracted from espacenet.com database on Sep. 28, 2023, 5 pages.
English language abstract and machine-assisted English translation for CN 105883919 A extracted from espacenet.com database on Sep. 27, 2023, 10 pages.
English language abstract and machine-assisted English translation for CN 110156082 A extracted from espacenet.com database on Sep. 27, 2023, 14 pages.
English language abstract and machine-assisted English translation for CN 111850686 A extracted from espacenet.com database on Sep. 27, 2023, 13 pages.
English language abstract and machine-assisted English translation for CN 112011804 A extracted from espacenet.com database on Sep. 28, 2023, 22 pages.
English language abstract and machine-assisted English translation for CN 112267017 A extracted from espacenet.com database on Sep. 28, 2023, 19 pages.
English language abstract and machine-assisted English translation for CN 112592180 A extracted from espacenet.com database on Sep. 27, 2023, 14 pages.
English language abstract and machine-assisted English translation for CN 114057227 A extracted from espacenet.com database on Sep. 27, 2023, 11 pages.
English language abstract and machine-assisted English translation for CN 114192791 A extracted from espacenet.com database on Sep. 28, 2023, 13 pages.
English language abstract and machine-assisted English translation for CN 114210973 B extracted from espacenet.com database on Sep. 28, 2023, 17 pages.
English language abstract and machine-assisted English translation for CN 1308566 A extracted from espacenet.com database on Sep. 28, 2023, 33 pages.
English language abstract and machine-assisted English translation for CN 202072753 U extracted from espacenet.com database on Sep. 28, 2023, 11 pages.
English language abstract and machine-assisted English translation for CN 202072754 U extracted from espacenet.com database on Sep. 28, 2023, 11 pages.
English language abstract and machine-assisted English translation for CN 202072755 U extracted from espacenet.com database on Sep. 28, 2023, 13 pages.
English language abstract and machine-assisted English translation for CN 204430275 U extracted from espacenet.com database on Sep. 28, 2023, 8 pages.
English language abstract and machine-assisted English translation for JP 2003-013115 A extracted from espacenet.com database on Sep. 28, 2023, 7 pages.
English language abstract and machine-assisted English translation for JP 2006-263504 A extracted from espacenet.com database on Sep. 27, 2023, 14 pages.
English language abstract and machine-assisted English translation for JP 2019-163542 A extracted from espacenet.com database on Sep. 28, 2023, 19 pages.
English language abstract and original Chinese language document of LIU, Jun et al., "Technology Study of Removing S from the Product Ta2O5/Nb2O5", Ningxia Orient Tantalum Industry, vol. 24, No. 10, 2005, 3 pages.
English language abstract and original Chinese language document of WAN, Lin-sheng et al., "On Size Characteristics Controlling of High-Purity Ta2O5 Powder", Jiangxi Nonferrous Metals, vol. 22, No. 3, Sep. 2008, 4 pages.
English language abstract and original Chinese language document of Yan, Hui-juan et al., "Technological Features and the Latest Development of Impurity Separation During Tantalum (Niobium) Oxide Production by Traditional Process", Rare Metals and Cemented Carbides, vol. 44, No. 4, Aug. 2016, 6 pages.
English language abstract and original Chinese languge document of Zhou, Jie-ying et al., "Influences of Neutralization Crystallization on the Particle Size of Ta2O5 Powder", Rare Metals and Cemented Carbides, vol. 39, No. 2, Jun. 2011, 5 pages.
English language abstract for and original Chinese language doument of He, Ji-Lin et al., "A New Method for Making Tantalum/Niobum Powder by Reducing Ta/Nb Oxide", Aug. 2003, 3 pages.
English language abstract for BE 1002754 A3 extracted from espacenet.com database on Sep. 27, 2023, 1 page.
English language abstract for BR 9000642 A extracted from espacenet. com database on Sep. 27, 2023, 1 page.
English language abstract for CN 1410209 A extracted from espacenet. com database on Sep. 28, 2023, 2 pages.
English language abstract for CN 101146918 A extracted from espacenet.com database on Sep. 27, 2023, 1 page.
English language abstract for CN 101574741 A extracted from espacenet.com database on Sep. 28, 2023, 2 pages.
English language abstract for CN 104918734 A extracted from espacenet.com database on Sep. 28, 2023, 2 pages.
English language abstract for CN 105033283 A extracted from espacenet.com database on Sep. 28, 2023, 2 pages.

(56) References Cited

OTHER PUBLICATIONS

English language abstract for CN 1251325 A extracted from espacenet.com database on Sep. 28, 2023, 2 pages.
English language abstract for CN 1340631 A extracted from espacenet.com database on Sep. 28, 2023, 1 page.
English language abstract for DD 291978 A5 extracted from espacenet.com database on Sep. 27, 2023, 1 page.
English language abstract for DE 39 04 292 A1 extracted from espacenet.com database on Sep. 27, 2023, 1 page.
English language abstract for JPH 02-248325 A extracted from espacenet.com database on Sep. 27, 2023, 1 page.
Gupta, C.K et al., "Preparation of High Purity Niobium", Journal of the Less-Common Metals, Vo.. 139, 1988, pp. 189-202.
International Search Report for Application No. PCT/CN2022/114372 dated Nov. 30, 2022, 6 pages.
International Search Report for Application No. PCT/CN2022/114374 dated Nov. 8, 2022, 2 pages.

* cited by examiner

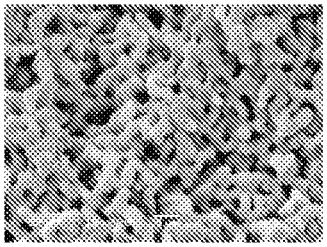

METHOD FOR PRODUCING TANTALUM POWDER AND TANTALUM POWDER OBTAINED BY THE METHOD

CROSS REFERENCE TO RELATED APPLICATION

The present application is the National Stage of International Patent Application No. PCT/CN2022/114375, filed on Aug. 24, 2022, which claims priority to and all the benefits of Chinese Application No. 202111533324.8, filed on Dec. 15, 2021, which are hereby expressly incorporated herein by reference in their entirety.

TECHNICAL FIELD

The present invention belongs to the field of smelting of rare metal functional materials, and particularly relates to a tantalum powder for manufacturing a high-reliability capacitor and a producing method thereof.

BACKGROUND

Tantalum electrolytic capacitor (hereinafter referred to as tantalum capacitor) has the advantages of high capacity, small volume, strong self-healing capability, high reliability and the like, and is widely applied to high-tech fields of communication, computers, automotive electronics, medical instruments, radars, aerospace, automatic control devices and the like. Tantalum powder is a key material for manufacturing tantalum capacitor, and only by using tantalum powder for capacitors with excellent withstand voltage, tantalum capacitor with good reliability can be produced, and the requirements of high-reliability of electronic devices and electronic circuits can be continuously met.

At present, industrial preparation methods of capacitor-grade tantalum powder mainly include sodium-reduction potassium fluorotantalate method, magnesium-reduction tantalum oxide method, tantalum ingot hydrogenation method and the like. No matter which method is used for preparing tantalum powder, in order to improve the electrical property of tantalum powder, the prepared tantalum raw powder needs to be subjected to subsequent treatments such as high-temperature high-vacuum heat treatment, oxygen reduction by reduction with metal magnesium. The high-temperature high-vacuum heat treatment process can remove gas impurities and a part of low-melting-point metal impurities adsorbed in the wet impurity removal process, and the reduction with metal magnesium can reduce the oxygen content of tantalum powder and improve the distribution of oxygen in tantalum powder; and the subsequent treatment can also cause tantalum metal particles to be aggregated and sintered, thereby improving the structure of tantalum metal particles and improving the electrical property of tantalum powder. In order to improve the withstand voltage of tantalum powder, general methods include increasing the sintering temperature, prolonging the sintering time and so on, but the increase of the sintering temperature and the prolongation of the sintering time may cause a loss of specific capacitance.

CN102120258B discloses a method for heat treatment of tantalum powder, which comprises the steps of firstly subjecting original tantalum powder to high-temperature vacuum heat treatment to obtain aggregated tantalum powder, and then mixing the heat-treated aggregated tantalum powder with a reducing agent for deoxidation heat treatment, and finally performing acid washing for impurity removal to obtain the tantalum powder suitable for the electrolytic capacitor. The tantalum powder prepared by the method has low oxygen content and good electrical property, but the tantalum powder particles prepared by the method have the problems of large loss, poor withstand voltage and the like. CN101189089B discloses a method for high-temperature vacuum heat treatment of metal powder by microwave energy, but the tantalum powder prepared by the method also has the problems of large leakage current and low breakdown voltage, and the equipment used has the disadvantages of high maintenance cost and low processing capacity.

In the prior art, there is still a self-propagating high-temperature synthesis method (SHS) for producing tantalum powder. However, this method requires a temperature of at least 2000° C. or more, and the reaction is too fast, which is not only difficult to control, but also has high requirements on process equipment. In addition, the tantalum powder obtained is not uniform and does not meet the need for manufacturing highly reliable capacitors.

In short, the tantalum powder prepared by the above methods has the defects of low breakdown voltage and the like, and is not suitable for manufacturing high-reliability capacitors.

DISCLOSURE

An object of the present invention is to provide tantalum powder for capacitors with high breakdown voltage and capable of meeting the requirements of manufacturing high-reliability capacitors. Another object is to provide a method for preparing the tantalum powder, which is characterized in that after the tantalum powder is subjected to oxygen reduction and activation treatment in molten salt by using metal magnesium, excessive metal magnesium is separated, and then the tantalum powder is sintered in the molten salt.

An object of the present invention is to provide a method for producing tantalum powder for capacitors. Compared with the tantalum powder for capacitors of the same grade produced by other methods, the tantalum powder for capacitors produced by the method has a high specific capacitance under high-voltage energization conditions, and a high breakdown voltage, and the withstand voltage of the tantalum powder for capacitors is significantly improved.

The present invention relates to a method for producing tantalum powder, comprising the steps of:

(1) uniformly mixing a tantalum powder raw material, metal magnesium and at least one alkali metal and/or alkaline earth metal halide, loading the mixture into a container, and putting the container in a heating furnace;

(2) raising the temperature of the heating furnace to 600-1200° C. in the presence of an inert gas, and soaking (or maintaining) for 1-4 h for example, so that oxygen in the tantalum powder and magnesium are subjected to a reduction reaction in the molten salt;

(3) at the end of soaking, lowering the temperature of the heating furnace to 600-800° C., vacuumizing (or evacuating) the interior of the heating furnace to 10 Pa or less, soaking under the negative pressure for 1-10 h for example, so that the excessive magnesium and the tantalum powder mixture are separated;

(4) thereafter, raising the temperature of the heating furnace to 750-1200° C. in the presence of an inert gas, and soaking for 1-10 h for example, so that the tantalum powder is sintered in the molten salt after oxygen reduction;

(5) then cooling to room temperature and passivating to obtain a mixed material containing halide and tantalum powder;

(6) separating the tantalum powder from the resulting mixture, for example by water washing, acid washing, filtration, and drying.

Preferably, the mass ratio of the tantalum powder to the alkali metal and/or alkaline earth metal halide in step (1) is 1:0.5-10.0, more preferably 1:0.5-3.0, and still more preferably 1:1.5-2.5. The metal magnesium is added in an amount of 1-5%, preferably 1.5-3% by weight of the tantalum powder. It is understood that the amount of the metal magnesium added is excessive for oxygen reduction, so magnesium overflow may also occur during the separation of magnesium.

Preferably, the magnesium in step 1) is magnesium particles. The particle size of the magnesium particles is not limited. However, after a great deal of research, the inventors find that magnesium particles with the particle size of 150-4000 μm are more suitable for this technology. The magnesium particles with the particle size range are not only beneficial to the safety during storage and transportation of the metal magnesium, but also beneficial to the uniform mixing. If the magnesium particles are too fine, the activity is too strong, and spontaneous combustion and ignition are easy to occur; if the magnesium particles are too coarse, uniform mixing is not so easy, and the performance optimization of the tantalum powder is not so easy.

The inert gas generally refers to rare gases such as helium, neon, and argon. Although nitrogen is sometimes used as an inert gas due to its stable properties, it is not suitable as an inert protective gas in the present invention because the temperature of step (2) is relatively high and the activity of nitrogen is very strong at this high temperature. However, after a great deal of research, the inventors has surprisingly found that the nitrogen doping of the tantalum powder can be achieved by the way when a small amount of nitrogen is contained in the inert gas without damaging the inert protective atmosphere. From the viewpoint of achieving a better nitrogen doping effect of the tantalum powder, the inert gas in step (2) may preferably contain 0.5 to 10% of nitrogen.

Preferably, the alkali metal or alkaline earth metal halide in step (1) is one or more of NaCl, KCl, KF, KI, and/or $MgCl_2$. The alkali metal halide may be sodium chloride and/or potassium chloride, preferably a mixture of sodium chloride and potassium chloride, more preferably a mixture of sodium chloride and potassium chloride in a ratio of 1:1-10, most preferably about 1:1. The alkali metal and/or alkaline earth metal halide is preferably in particulate form. The particle size thereof is not limited, but the inventors find that the particles of 70-4000 μm are more suitable for this technology, and the tantalum powder obtained by reduction has better withstand voltage.

Preferably, one or more compounds containing B, P and/or N elements can be added as additive(s) in step (1) to dope the tantalum powder. Based on the amount of effective element, the B element is preferably added in an amount of 1-100 ppm, more preferably 20-60 ppm; the P element is preferably added in an amount of 10-200 ppm, more preferably 30-90 ppm; the N element is preferably added in an amount of 300-2500 ppm, more preferably 500-1200 ppm. It should be understood that although the compound(s) is (are) added here, the effective elements are B, P, and/or N, so the amounts referred to here are calculated as B, P and/or N.

The main object of step (2) is to effect oxidation reduction and/or activation of tantalum powder.

Preferably, in step (2), the heating furnace is heated to 750-1000° C. More preferably, the heating furnace is heated to 850-1000° C.

Preferably, in step (3), the temperature of the heating furnace is 650-800° C. More preferably, the temperature is 650-720° C. Preferably, in this step, the interior of the heating furnace is vacuumized to 5 Pa or less, preferably 0.5 Pa or less.

Preferably, in step (4), the heating furnace is heated to 900-1050° C.

The inert gas in step (2) may be the same as or different from the inert gas in step (4). Preferably, in steps (2) and/or (4), a positive voltage is maintained in the furnace.

Preferably, the method of the present invention further comprises, after step (6), subsequent treatment such as high-temperature high-vacuum heat treatment, oxygen reduction, acid washing and the like to obtain tantalum powder suitable for manufacturing high-reliability tantalum capacitors. These treatments are all processes known in the art. In other words, these treatments may employ any processes known in the art. For example, the high-temperature high-vacuum heat treatment and passivation may be performed by using processes provided in the patents CN201110039272.9, CN201120077798.1, CN201120077680.9, CN201120077305.4 and the like, the oxygen reduction may be performed by using processes provided in the patents CN201420777210.7 and CN201420777210.7, and the acid washing may be performed by using processes provided in the patents CN201210548101.3, CN201280077499.5, CN201210548008.2 and the like.

Instead of doping the N, P and/or B elements in step (1), a step of doping these elements separately may also be included in the present invention, for example, after step (6). Of course, raw materials containing these elements may be used as they are. These elements may also be added in the high-temperature high-vacuum heat treatment step described previously. It is particularly preferable to add the P element. The addition of the P element can improve the specific capacitance, and the effect of improving the specific capacitance is the same whenever the P element is added as long as the total amount of P doped is controlled well.

The present invention also relates to tantalum powder suitable for manufacturing high-reliability tantalum capacitors, which is characterized in that an anode block manufactured by using the tantalum powder is energized under high voltage conditions, and the energized block is tested for electrical performance. It is found that the energized block has a higher specific capacitance and shows a higher breakdown voltage in the breakdown voltage test.

There is no limitation on the tantalum powder raw material to be treated herein.

Moreover, the process of the present invention is simple and easy to control. For example, any step of the present invention does not involve the use of microwave, or the use of too high temperatures above 1300° C. Therefore, the equipment used is simpler, and the safety of the tantalum powder sintering process is better.

Without being bound to a general theory, through analysis of principle by combining the theory of powder liquid phase sintering, the inventors believe that the reason why the present invention achieves excellent effects resides in that: in step (2), with the rise of the temperature, the metal magnesium and the alkali metal or alkaline earth metal halide are melted and present as liquid phase, the liquid magnesium, for having higher reducibility, reduces oxygen on the tantalum powder, and increases the surface activity of tantalum powder particles; then, upon sintering in the liquid phase of the molten salt, the corners, projections of large particles in the tantalum powder and ultrafine tantalum powder particles are dissolved in the liquid phase. As the process continues, tantalum has a concentration in the liquid phase that exceeds the saturation concentration, and then preferentially deposits on certain sites in the large particles of tantalum and coalesces as a part of the large particles. As such, the tantalum powder has smooth particles, thick sintering neck and less ultrafine particles. Thereafter, the obtained tantalum powder is subjected to high-temperature high-vacuum sintering, oxygen reduction and acid washing treatment according to the prior art, thereby obtaining tantalum powder suitable for manufacturing high-voltage high-reliability capacitors.

BRIEF DESCRIPTION OF THE DRAWINGS

The following FIGURE is provided for a better understanding of the present invention. The FIGURE is exemplary and not intended to limit the scope of the present invention.

FIG. 1 shows a scanning electron micrograph of the tantalum powder obtained according to the present invention.

The FIGURE illustrates that the obtained tantalum powder has more uniform distribution, smooth particles, thick sintering neck and less ultrafine particles.

DETAILED DESCRIPTION

Examples

In order to further illustrate the present invention, the preferred embodiments of the present invention are described in combination with the accompanying examples, from which the objects, features and advantages of the present invention can be clearly seen. The description is intended only to further illustrate the features and advantages of the present invention, not to limit the present invention. The examples were carried out under conventional conditions if the specific conditions are not specified. The reagents or instruments used are commercially available conventional products if the manufacturer is not specified.

For the purposes of the present specification, all numbers expressing amounts of ingredients, reaction conditions and the like in the specification and claims are to be understood as being modified in all instances by the term "about" unless otherwise indicated. Accordingly, the numerical parameters given in the following specification and attached claims are approximate values that may vary depending upon the desired properties sought to be obtained by the present invention, unless otherwise indicated. At the very least, and not intended to limit the application of the principle of equivalence in the scope of claims, each numerical parameter should be interpreted at least according to the number of reported significant digits and the usual rounding technique.

The content of impurities in the tantalum powder is analyzed according to the Chinese standard GB/T15076.1-15076.15, and the physical properties are tested according to the industry standard YS/T573-2015. The electrical performance of the tantalum powder is tested according to the Chinese standard GB/T3137.

Example 1

5.0 kg of tantalum powder obtained by reducing potassium fluotantalate with sodium was mixed with 2.0% of metal magnesium particles by weight of the tantalum powder and simultaneously with 3.75 kg of potassium chloride (KCl). After uniformly mixing, the obtained mixture was loaded into a reaction vessel, and air in the reaction vessel was evacuated. Argon was introduced into the reaction vessel, and, under the condition of keeping positive pressure, the reaction vessel was put into a heating furnace for heating to a temperature of 900° C., followed by soaking for 4.0 h. Then, the reaction vessel was cooled to a temperature of 720° C., and vacuumized so that the pressure in the reaction vessel was lowered to 5.7 Pa, followed by soaking for 3 h, and vacuumizing was stopped. Then, argon was introduced into the reaction vessel, and, under the condition of keeping positive pressure, the reaction vessel was heated to 950° C., followed by soaking for 5 h. After the soaking was finished, the reaction vessel was cooled to room temperature, and passivation treatment was carried out. Thereafter, the obtained mixture of the halide and the tantalum powder was subjected to water washing, acid washing, filtering and drying, to obtain tantalum powder. The tantalum powder obtained was subjected to high-temperature high-vacuum heat treatment for 0.5 h at 1400° C. and under a pressure of less than $5.0\times10^{-3}$ Pa, and then to oxygen reduction and acid cleaning to obtain tantalum powder.

The tantalum powder was made into an anode block according to the anode block mass, pressed density, anode block sintering temperature, sintering time specified in Table 1, and other conditions as per the above-mentioned GB/T3137 requirements, energized at 150 V, and then tested for electrical properties as per the above-mentioned GB/T3137 requirements. The test results are listed in Table 1.

Example 2

5.0 kg of tantalum powder obtained by reducing potassium fluotantalate with sodium was mixed with 2.0% of metal magnesium particles by weight of the tantalum powder and simultaneously with 2.0 kg of potassium chloride (KCl) and 2.0 kg of sodium chloride (NaCl). After uniformly mixing, the obtained mixture was loaded into a reaction vessel, and air in the reaction vessel was separated (i.e., evacuated). Argon was introduced into the reaction vessel, and, under the condition of keeping positive pressure, the reaction vessel was put into a heating furnace for heating to a temperature of 980° C., followed by soaking for 4.0 h. Then, the reaction vessel was cooled to a temperature of 680° C., and vacuumized so that the pressure in the reaction vessel was lowered to 5.7 Pa, followed by soaking for 6 h, and vacuumizing was stopped. Then, argon was introduced into the reaction vessel, and, under the condition of keeping positive pressure, the reaction vessel was heated to 900° C., followed by soaking for 3 h. After the soaking was finished, the reaction vessel was cooled to room temperature, and passivation treatment was carried out. Thereafter, the obtained mixture of the halide and the tantalum powder was subjected to water washing, acid washing, filtering and drying, to obtain tantalum powder with improved particle structure. The tantalum powder obtained was subjected to high-temperature high-vacuum heat treatment for 0.5 h at 1400° C. and under a pressure of less than $5.0\times10^{-3}$ Pa, and then to oxygen reduction and acid cleaning to obtain tantalum powder.

The tantalum powder was made into an anode block according to the anode block mass, pressed density, anode block sintering temperature, sintering time specified in Table 1, and other conditions as per the above-mentioned GB/T3137 requirements, energized at 150 V, and then tested for electrical properties as per the above-mentioned GB/T3137 requirements. The test results are listed in Table 1.

Example 3

5.0 kg of tantalum powder obtained by reducing potassium fluotantalate with sodium, comprising a compound comprising 50 ppm phosphorus, was mixed with 2.0% of metal magnesium particles by weight of the tantalum powder and simultaneously with 2.0 kg of potassium chloride (KCl) and 2.0 kg of sodium chloride (NaCl). After uniformly mixing, the obtained mixture was loaded into a reaction vessel, and air in the reaction vessel was separated. Argon was introduced into the reaction vessel, and, under the condition of keeping positive pressure, the reaction vessel was put into a heating furnace for heating to a temperature of 850° C., followed by soaking for 4.0 h. Then, the reaction vessel was cooled to a temperature of 720° C., and vacuumized so that the pressure in the reaction vessel was lowered to 5.7 Pa, followed by soaking for 3 h, and vacuumizing was stopped. Then, argon was introduced into the reaction vessel, and, under the condition of keeping positive pressure, the reaction vessel was heated to 920° C., followed by soaking for 5 h. After the soaking was finished, the reaction vessel was cooled to room temperature, and passivation treatment was carried out. Thereafter, the obtained mixture of the halide and the tantalum powder was subjected to water washing, acid washing, filtering and drying, to obtain tantalum powder with improved particle structure. The tantalum powder obtained was subjected to high-temperature high-vacuum heat treatment for 0.5 h at 1420° C. and under a pressure of less than $5.0\times10^{-3}$ Pa, and then to oxygen reduction by reducing with magnesium and acid cleaning to obtain tantalum powder.

The tantalum powder was made into an anode block according to the anode block mass, pressed density, anode block sintering temperature, sintering time specified in Table 1, and other conditions as per the above-mentioned GB/T3137 requirements, energized at 150 V, and then tested for electrical properties as per the above-mentioned GB/T3137 requirements. The test results are listed in Table 1.

Example 4

5.0 kg of tantalum powder obtained by reducing potassium fluotantalate with sodium, comprising a compound comprising 800 ppm nitrogen, was mixed with 2.0% of metal magnesium particles by weight of the tantalum powder and simultaneously with 2.0 kg of potassium chloride (KCl) and 2.0 kg of sodium chloride (NaCl). After uniformly mixing, the obtained mixture was loaded into a reaction vessel, and air in the reaction vessel was separated. Argon was introduced into the reaction vessel, and, under the condition of keeping positive pressure, the reaction vessel was put into a heating furnace for heating to a temperature of 920° C., followed by soaking for 4.0 h. Then, the reaction vessel was cooled to a temperature of 720° C., and vacuumized so that the pressure in the reaction vessel was lowered to 5.7 Pa, followed by soaking for 6 h, and vacuumizing was stopped. Then, argon was introduced into the reaction vessel, and, under the condition of keeping positive pressure, the reaction vessel was heated to 950° C., followed by soaking for 5 h. After the soaking was finished, the reaction vessel was cooled to room temperature, and passivation treatment was carried out. Thereafter, the obtained mixture of the halide and the tantalum powder was subjected to water washing, acid washing, filtering and drying, to obtain tantalum powder with improved particle structure. The tantalum powder obtained was subjected to high-temperature high-vacuum heat treatment for 0.5 h at 1400° C. and under a pressure of less than $5.0\times10^{-3}$ Pa, and then to oxygen reduction and acid cleaning to obtain tantalum powder.

The tantalum powder was made into an anode block according to the anode block mass, pressed density, anode block sintering temperature, sintering time specified in Table 1, and other conditions as per the above-mentioned GB/T3137 requirements, energized at 150 V, and then tested for electrical properties as per the above-mentioned GB/T3137 requirements. The test results are listed in Table 1.

Example 5

5.0 kg of tantalum powder obtained by reducing potassium fluotantalate with sodium, comprising a compound comprising 50 ppm boron, was mixed with 2.0% of metal magnesium particles by weight of the tantalum powder and simultaneously with 2.0 kg of potassium chloride (KCl) and 2.0 kg of sodium chloride (NaCl). After uniformly mixing, the obtained mixture was loaded into a reaction vessel, and air in the reaction vessel was separated. Argon was introduced into the reaction vessel, and, under the condition of keeping positive pressure, the reaction vessel was put into a heating furnace for heating to a temperature of 920° C., followed by soaking for 4.0 h. Then, the reaction vessel was cooled to a temperature of 720° C., and vacuumized so that the pressure in the reaction vessel was lowered to 5.7 Pa, followed by soaking for 6 h, and vacuumizing was stopped. Then, argon was introduced into the reaction vessel, and, under the condition of keeping positive pressure, the reaction vessel was heated to 950° C., followed by soaking for 5 h. After the soaking was finished, the reaction vessel was cooled to room temperature, and passivation treatment was carried out. Thereafter, the obtained mixture of the halide and the tantalum powder was subjected to water washing, acid washing, filtering and drying, to obtain tantalum powder with improved particle structure. The tantalum powder obtained was subjected to high-temperature high-vacuum heat treatment for 0.5 h at 1400° C. and under a pressure of less than $5.0\times10^{-3}$ Pa, and then to oxygen reduction and acid cleaning to obtain tantalum powder.

The tantalum powder was made into an anode block according to the anode block mass, pressed density, anode block sintering temperature, sintering time specified in Table 1, and other conditions as per the above-mentioned GB/T3137 requirements, energized at 150 V, and then tested for electrical properties as per the above-mentioned GB/T3137 requirements. The test results are listed in Table 1.

Comparative Example 1

5.0 kg of tantalum powder obtained by reducing potassium fluotantalate with sodium, comprising a compound comprising 50 ppm phosphorus, was directly subjected to high-temperature high-vacuum heat treatment for 0.5 h at 1400° C., and then to oxygen reduction and acid cleaning to obtain tantalum powder.

The tantalum powder was made into an anode block according to the anode block mass, pressed density, anode block sintering temperature, sintering time specified in Table 1, and other conditions as per the above-mentioned GB/T3137 requirements, energized at 150 V, and then tested for electrical properties as per the above-mentioned GB/T3137 requirements. The test results are listed in Table 1.

TABLE 1

Electrical performance data of finished tantalum powder

| Sample | Pressed density ($g/cm^3$) | Mass of anode block (g) | Sintering temperature (° C.) | Sintering time (min) | Forming voltage (V) | Specific capacitance (μFV/g) | Breakdown voltage (V) | Residual current (nA/μFV) |
|---|---|---|---|---|---|---|---|---|
| Example 1 | 6.0 | 0.5 | 1500 | 30 | 150 | 15700 | 245 | 0.36 |
| Example 2 | 6.0 | 0.5 | 1500 | 30 | 150 | 15600 | 243 | 0.42 |
| Example 3 | 6.0 | 0.5 | 1500 | 30 | 150 | 17600 | 246 | 0.49 |
| Example 4 | 6.0 | 0.5 | 1500 | 30 | 150 | 16800 | 252 | 0.25 |
| Example 5 | 6.0 | 0.5 | 1500 | 30 | 150 | 17000 | 243 | 0.35 |
| Comparative Example 1 | 6.0 | 0.5 | 1500 | 30 | 150 | 13500 | 193 | 2.48 |

Example 6

5.0 kg of tantalum powder obtained by reducing tantalum oxide with magnesium was mixed with 2.3% of metal magnesium particles by weight of the tantalum powder and simultaneously with 5.0 kg of potassium chloride (KCl). After uniformly mixing, the obtained mixture was loaded into a reaction vessel, and air in the reaction vessel was separated. Argon was introduced into the reaction vessel, and, under the condition of keeping positive pressure, the reaction vessel was put into a heating furnace for heating to a temperature of 950° C., followed by soaking for 4.0 h. Then, the reaction vessel was cooled to a temperature of 720° C., and vacuumized so that the pressure in the reaction vessel was lowered to 5.7 Pa, followed by soaking for 2 h, and vacuumizing was stopped. Then, argon was introduced into the reaction vessel, and, under the condition of keeping positive pressure, the reaction vessel was heated to 900° C., followed by soaking for 6 h. After the soaking was finished, the reaction vessel was cooled to room temperature, and passivation treatment was carried out. Thereafter, the obtained mixture of the halide and the tantalum powder was subjected to water washing, acid washing, filtering and drying, to obtain tantalum powder.

The tantalum powder obtained was subjected to high-temperature high-vacuum heat treatment for 0.5 h at 1420° C. and under a pressure of less than $5.0\times10^{-3}$ Pa, and then to oxygen reduction and acid cleaning to obtain tantalum powder. The tantalum powder was made into an anode block according to the anode block mass, pressed density, anode block sintering temperature, sintering time specified in Table 2, and other conditions as per the above-mentioned GB/T3137 requirements, energized at 200 V, and then tested for electrical properties as per the above-mentioned GB/T3137 requirements. The test results are listed in Table 2.

Example 7

5.0 kg of flake tantalum powder comprising a compound comprising 1500 ppm nitrogen and a compound comprising 50 ppm boron was mixed with 2.8% of metal magnesium particles by weight of the tantalum powder and simultaneously with 5 kg of potassium chloride (KCl) and 2.5 kg of potassium fluoride (KF). After uniformly mixing, the obtained mixture was loaded into a reaction vessel, and air in the reaction vessel was separated. Argon was introduced into the reaction vessel, and, under the condition of keeping positive pressure, the reaction vessel was put into a heating furnace for heating to a temperature of 950° C., followed by soaking for 4.0 h. Then, the reaction vessel was cooled to a temperature of 700° C., and vacuumized so that the pressure in the reaction vessel was lowered to 5.7 Pa, followed by soaking for 6 h, and vacuumizing was stopped. Then, argon was introduced into the reaction vessel, and, under the condition of keeping positive pressure, the reaction vessel was heated to 950° C., followed by soaking for 5 h. After the soaking was finished, the reaction vessel was cooled to room temperature, and passivation treatment was carried out. Thereafter, the obtained mixture of the halide and the tantalum powder was subjected to water washing, acid washing, filtering and drying, to obtain tantalum powder.

The tantalum powder obtained was subjected to high-temperature high-vacuum heat treatment for 0.5 h at 1500° C. and under a pressure of less than $5.0\times10^{-3}$ Pa, and then to oxygen reduction and acid cleaning to obtain tantalum powder. The tantalum powder was made into an anode block according to the anode block mass, pressed density, anode block sintering temperature, sintering time specified in Table 2, and other conditions as per the above-mentioned GB/T3137 requirements, energized at 270 V, and then tested for electrical properties as per the above-mentioned GB/T3137 requirements. The test results are listed in Table 2.

TABLE 2

Electrical performance data of finished tantalum powder

| Sample | Pressed density ($g/cm^3$) | Mass of anode block (g) | Sintering temperature (° C.) | Sintering time (min) | Forming voltage (V) | Specific capacitance (μFV/g) | Breakdown voltage (V) | Residual current (nA/μFV) |
|---|---|---|---|---|---|---|---|---|
| Example 6 | 6.0 | 0.5 | 1420 | 30 | 200 | 18400 | 264 | 0.13 |
| Example 7 | 6.0 | 0.5 | 1600 | 30 | 270 | 12200 | 347 | 0.14 |

It can be seen from Table 1 and Table 2 that: the present invention has the following advantages compared to the prior art: tantalum powder produced according to the present invention is energized under high voltage conditions, and the energized block is tested for electrical performance, which demonstrates that the energized block has a higher specific capacitance and shows a higher breakdown voltage in the breakdown voltage test.

Therefore, the tantalum powder produced according to the present invention is more suitable for manufacturing high-reliability tantalum capacitors.

The invention claimed is:

1. A method for producing tantalum powder, the method comprising the steps of:

(1) uniformly mixing a tantalum powder raw material, metal magnesium and at least one alkali metal halide and/or alkaline earth metal halide, loading the mixture into a container, and putting the container in a heating furnace;

(2) raising the temperature of the heating furnace to 600-1200° C. in the presence of an inert gas, and soaking the mixture;

(3) at the end of soaking, lowering the temperature of the heating furnace to 600-800° C., vacuumizing an interior of the heating furnace to 10 Pa or less, and soaking under a negative pressure so that unreacted metal magnesium is separated;

(4) thereafter, raising the temperature of the heating furnace to 750-1200° C. in the presence of an inert gas, and soaking to melt the alkali metal halide and/or alkaline earth metal halide and obtain a molten salt, so that the tantalum powder is sintered in the molten salt after oxygen reduction, wherein the inert gas in step (4) is the same as or different from the inert gas in step (2);

(5) then cooling to room temperature and passivating to obtain a mixed material containing the alkali metal halide and/or alkaline earth metal halide and the tantalum powder; and (6) separating the tantalum powder from the resulting mixture.

2. The method according to claim 1, characterized in that: a mass ratio of the tantalum powder to the alkali metal halide and/or alkaline earth metal halide in step (1) is 1:0.5-10.0, and/or the metal magnesium is added in an amount of 1-5% by weight of the tantalum powder.

3. The method according to claim 2, characterized in that: the alkali metal halide or alkaline earth metal halide in step (1) is one or more of NaCl, KCl, KF, KI and $MgCl_2$.

4. The method according to claim 1, characterized in that: the alkali metal halide or alkaline earth metal halide in step (1) is one or more of NaCl, KCl, KF, KI and $MgCl_2$.

5. The method according to claim 1, characterized in that: one or more compounds containing B, P and/or N elements are added as additive(s) in step (1) to dope the tantalum powder.

6. The method according to claim 5, characterized in that: the B element is added in an amount of 1-100 ppm; and/or the P element is added in an amount of 10-200 ppm; and/or the N element is added in an amount of 300-2500 ppm, with each ppm based on the weight of tantalum powder.

7. The method according to claim 5, characterized in that: the B element is added in an amount of 20-60 ppm; and/or the P element is added in an amount of 30-90 ppm; and/or the N element is added in an amount of 500-1200 ppm, with each ppm based on the weight of the tantalum powder.

8. The method according to claim 1, characterized in that: the inert gas in step (4) is the same as the inert gas in step (2).

9. The method according to claim 1, further comprising, after step (6), at least one of the following steps of high-temperature high-vacuum heat treatment and separating by acid washing, filtration and drying.

10. The method according to claim 1, characterized in that: the alkali metal halide or alkaline earth metal halide in step (1) is mixture of NaCl and KCl.

11. The method according to claim 1, characterized in that: in step (2), the temperature of the heating furnace is raised to 750-1000° C. and the mixture is soaked for 1-4 h.

12. The method according to claim 11, characterized in that: in step (3), the temperature of the heating furnace is lowered to 650-800° C., the interior of the heating furnace is vacuumized to 5 Pa or less, and the soaking under the negative pressure is conducted for 1-10 h.

13. The method according to claim 12, characterized in that: in step (4), the temperature of the heating furnace is raised to 900-1050° C. and the soaking is conducted for 1-10 h.

14. The method according to claim 1, characterized in that: the mass ratio of the tantalum powder to the alkali metal halide and/or alkaline earth metal halide in step (1) is 1:0.5-3.0, and/or the metal magnesium is added in an amount of 1.5-3% by weight of the tantalum powder.

* * * * *